US005499793A

United States Patent [19]

Salansky

[11] Patent Number: 5,499,793

[45] Date of Patent: Mar. 19, 1996

[54] COPY HOLDING DEVICE

[76] Inventor: Charles A. Salansky, 194 Voorhees Ave., Buffalo, N.Y. 14214

[21] Appl. No.: 318,967

[22] Filed: Oct. 6, 1994

[51] Int. Cl.[6] ..... A47F 7/14

[52] U.S. Cl. ..... 248/442.2; 248/447; 248/918; 400/718; 160/370.22; 160/24

[58] Field of Search ..... 248/918, 442.2, 248/452, 282, 231.4, 448, 447, 458; 40/341; 400/718; 160/24, 370.22

[56] References Cited

U.S. PATENT DOCUMENTS

| | | | |
|---|---|---|---|
| 3,454,075 | 7/1969 | Weinstein | 160/238 |
| 4,150,807 | 4/1979 | Manso | 248/452 |
| 5,035,392 | 7/1991 | Gross et al. | 248/442.2 |
| 5,052,650 | 10/1991 | Beile et al. | 248/451 |
| 5,082,235 | 1/1992 | Crowther | 248/918 |
| 5,292,099 | 3/1994 | Isham et al. | 248/442.2 |
| 5,383,642 | 1/1995 | Stassberg | 248/442.2 |

*Primary Examiner*—Leslie A. Braun
*Assistant Examiner*—Gwendolyn Wrenn
*Attorney, Agent, or Firm*—Crossetta & Associates

[57] ABSTRACT

The present invention features a document holder for attachment to a computer monitor where opposing panels are arranged on an adjustable width frame which is attached to the monitor, the panels being pivotal to adjustable open positions where they are configured to hold documents and to a closed position wherein they secure the monitor screen and the documents from unauthorized viewing while shielding same from dust. Provision is also made for retractable flexible dust covers which can be extended to shield the top of the monitor and a keyboard from dust.

19 Claims, 6 Drawing Sheets

COPY HOLDING DEVICE

FIELD OF THE INVENTION

This application relates to a novel device for supporting documents and the like in an upright position proximate a video monitor such as a computer monitor. The copy holding device of the invention provides means for securing a document and/or the video monitor screen from undesired view and further comprises means for shielding a video monitor and/or other computer component from dust.

BACKGROUND OF THE INVENTION

There is a continuing need for an efficient means to securely hold documents such as loose papers and the like in easily removable arrangement at a convenient position for viewing while working at a computer monitor. To that end, various devices have been produced which function to hold such documents, however most are not easily adjustable to the convenience of the user and there appears to be a lack of devices which have further functions including securing documents and/or the monitor screen from view and shielding the monitor from dust.

One copy holding device of the prior art is a free standing copyholder which holds documents on a flat, generally vertically oriented surface which is configured to allow positioning of the copyholder separate from and adjacent to the monitor. Such holder, as described in U.S. Pat. No. 5,052,650 has significant disadvantages to the user in that it takes up valuable desk top surface in the vicinity of the computer monitor, generally is difficult to position close enough to the monitor to provide convenient viewing and when not in use becomes an undesirable addition to the desk top clutter which in itself is a problem in the secretaries daily work routine.

Another type of copy holding device commonly used to hold documents in the age of computerized business records generally comprises an arm which is typically removably attached at one end to the computer monitor and comprises a clip which is arranged along the arm in such manner as to grip a document so that the document vertically dangles therefrom. For a single page document such device can be adequate. The failure to provide a surface backing the document generally precludes convenient notations, measurements or the like from being made upon the dangling document during the secretarial work effort and certainly such devices were not configured for securing a document from view or shielding the monitor from dust. When pressed into service to hold multi-page documents, changing viewing sheets of document becomes difficult if not impossible and the force being exerted at the points of attachment of the arm to the computer can create a problem in unexpected and disastrous detachment of the copyholder from the monitor.

An object of the present invention is to provide a novel holder for securing loose documents and the like, proximate a computer monitor for convenient viewing of the documents by the user.

Another object of the invention is to provide a novel holder that has the further capability of functioning as a dust shield for the computer screen.

Still another object of the invention is to provide a copy holder that can be used to shield the subject matter being viewed and/or on the monitor screen from unauthorized view.

A still further object is to provide a copyholder that can securely hold multi-page documents in a viewing position for the user.

A further object is to provide a holder which comprises means for shielding openings contained in a computer monitor from dust.

A still further object is to provide a holder which comprises means for shielding a keyboard, arranged adjacent a computer monitor, from dust.

These and other objects of the invention will become apparent from the following description of the invention.

SUMMARY OF THE INVENTION

The instant invention features a document holder that generally comprises first and second panels pivotally attached to opposite ends of an attachment frame connected to the monitor. The attachment frame comprises a generally horizontally arranged elongate upper attachment member, having opposing first and second attachment end members extending downwardly from opposite ends of the elongate upper member. The upper member is arranged for mounting along an upper surface of the monitor, the opposing end members are arranged for mounting along opposite side surfaces of the monitor.

The opposing first and second panels each have a pivoting end and an opening end in respective opposing relationship to each other, with the pivoting end of the first panel being arranged adjacent a first opposing end member and the pivoting end of the second opposing panel being arranged adjacent a second opposing end member. Such arrangement of the first and second panels in respect to end members of the attachment frame is such that the opening ends of the first and second panels can be pivoted toward and away from each other so that the panels can cover the screen of the monitor when in a closed position.

The panels can be the same or different size, but are generally sized to support standard and/or legal sized paper. To accommodate such sizing it is preferred that the panels be of sufficient width so as to overlap when in the closed position opposite the screen of the monitor, however, it should be understood that such is not necessary and it is contemplated as within this invention to include panels which neither overlap nor extend sufficiently to engage each other when in the closing position.

One or more of the panels is fitted with a document securing means for securing the document on a face of the panel during use. In a preferred embodiment the document securing means comprises a spring loaded, or the like holding device, which securely grips the documents to the panel.

In a further preferred embodiment one or more of the panels comprise a ledge or the like which extends outwardly from the face of a panel on which the document can rest. Generally, when opposing panels comprise such ledge the panels are of different heights or are otherwise arranged so that the ledge of one panel does not engage the other panel when in a closed position.

In a still further preferred embodiment, a lineguide is moveable mounted along a panel and is arranged to restrain the document against the panel and/or provide convenient means for the viewer to register a particular point or line of interest on the document for organized viewing of a document.

In yet another embodiment, a cover, preferably transparent, is mounted to a panel and is arranged to cover a document held on a panel.

The panels of the invention can be in any convenient polygonal shape or form, but generally a rectangular shape is preferred for organizational convenience when the document holder is to be used with conventional and/or rectangular documents and securing of a document and/or screen from view is a desirable function. Similarly, though the panels are typically generally planar, they may be ornamentally decorated with embossing, raised decorative ornamentation, recitations, padding and the like, depending upon the preference of the user. Generally it is preferred that the panels be rigid, or at least semi-rigid, so as to provide structural rigidity to the copy holder.

A panel can be formed from a cellulosic material such as a pressed paper, cardboard, wood or the like, and may contain a decorative surface layer which may comprise the same or different material such as wood, leather, vinyl or the like. In a preferred embodiment, the panel is formed from a metal or a polymeric material, with or without a decorative surface.

The elongate upper member of the attachment frame may be of fixed or variable length. In a preferred embodiment the upper member comprises plates which slidably engage to enable adjustment of the length of the member to fit a desirable monitor. In a preferred embodiment, end members comprise plates which are attached to, or, are integral with the ends of the upper member.

Generally, the attachment frame is connected to the monitor through adhesive strips and/or hook and loop type fasteners. In a preferred embodiment, the upper member and end members comprise hook and loop means for attaching the attachment frame to the monitor.

In an embodiment of the invention, the upper member comprises a means for shielding a surface of the monitor from dust. A preferred means for shielding comprises a retractable cover wherein the cover is gathered within a confined area when in the retracted position.

In a most preferred embodiment the means for shielding comprises a shade type device which is engaged with the upper member, wherein the cover is a flexible material which is gathered around a cylindrical member which in turn is retractably loaded about an inner axle. The axle is supported at both ends and as the cover is extended from the cylindrical member it rotates about the axle, preferably with spring retractable tension. The cover is connected to the monitor at an extended position for shielding openings in the monitor from dust. The cover is disconnected and retracts to a gathered position on the upper member when not in use.

In a further preferred embodiment, a similar retractable cover as described above is arranged between lower ends of opposing side members, or otherwise attached, in an arrangement to allow extending of a cover from a cylindrical gathering member over a keyboard, printer or the like which is juxtaposed from the monitor screen.

The panels may be pivotally attached by any convenient means to the attachment frame. Generally, pivot means may comprise hinging means or the like which may be connected among the panels, end members and upper member of the attachment means. Generally, it preferred that the panels be arranged between pivot points at an end of the upper member and a lower end of an end member.

In a preferred embodiment the invention further comprises means for adjusting a panel to a plurality of pivot resistant positions. Thus, such means allow a panel to be arranged through a multiplicity of pivot positions as may be desired by the user and be maintained at a desirable pivot position by means which resist further pivoting unless such resistance is specifically overcome by the user.

One preferred means comprises a cog and groove arrangement wherein a cog engages a groove during the pivoting movement of the panel to resist further movement of the panel through the pivot. In one such arrangement, the cog and groove are arranged so that downward weight of the panel causes the engagement of the mechanism and the user merely causes the panel to raise to continue pivoting. In another such arrangement the cog or groove displace from engagement by forced pivoting of the panel or by deformation thereof away from engagement.

The nature and mode of operation of the present invention will now be more fully described in the following detailed description of the accompanying drawings.

DESCRIPTION OF THE PREFERRED EMBODIMENT

Figure 1:
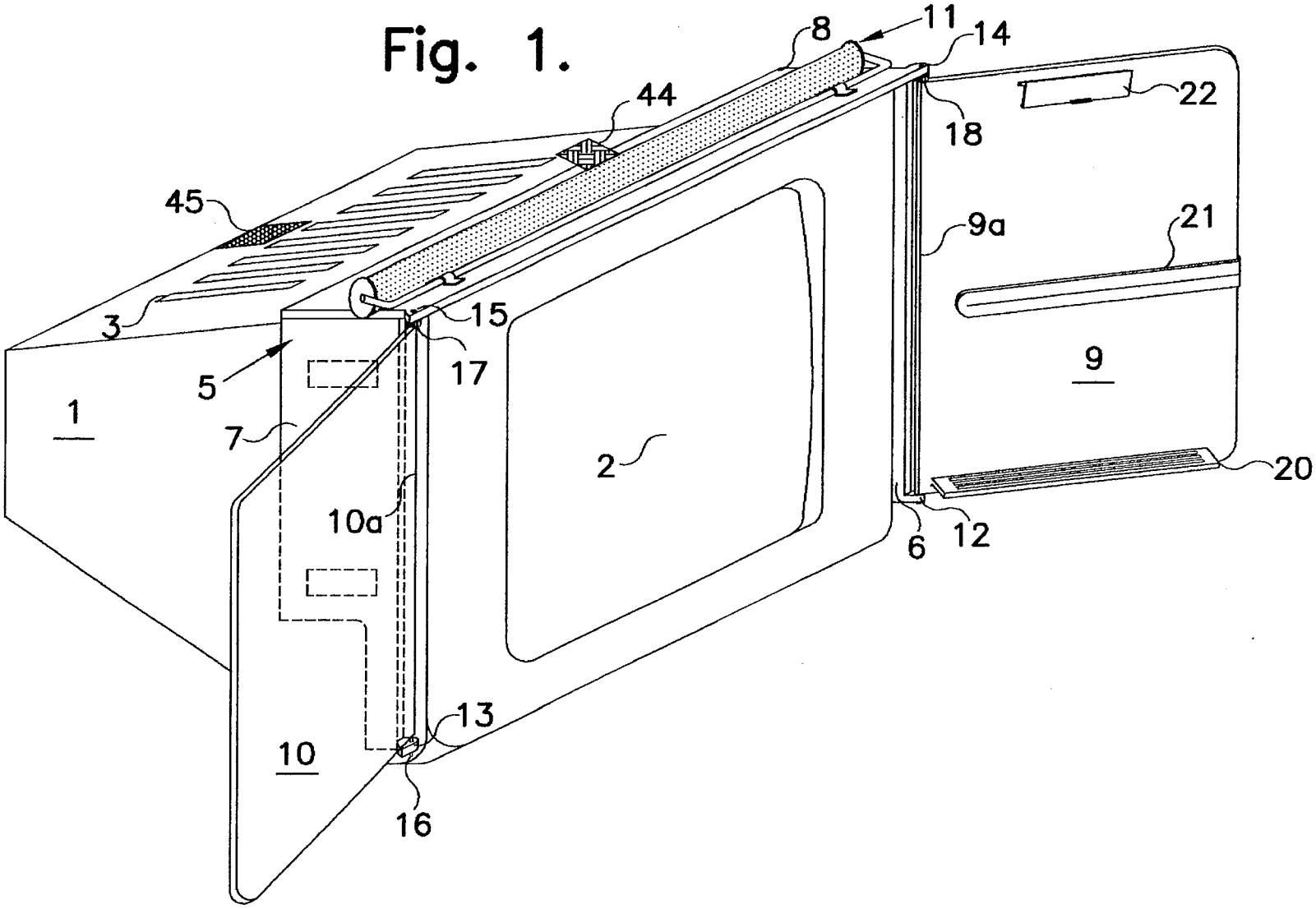
FIG. 1 is a perspective view of a copy holder of the invention mounted to a computer monitor in an open position.
Figure 2:
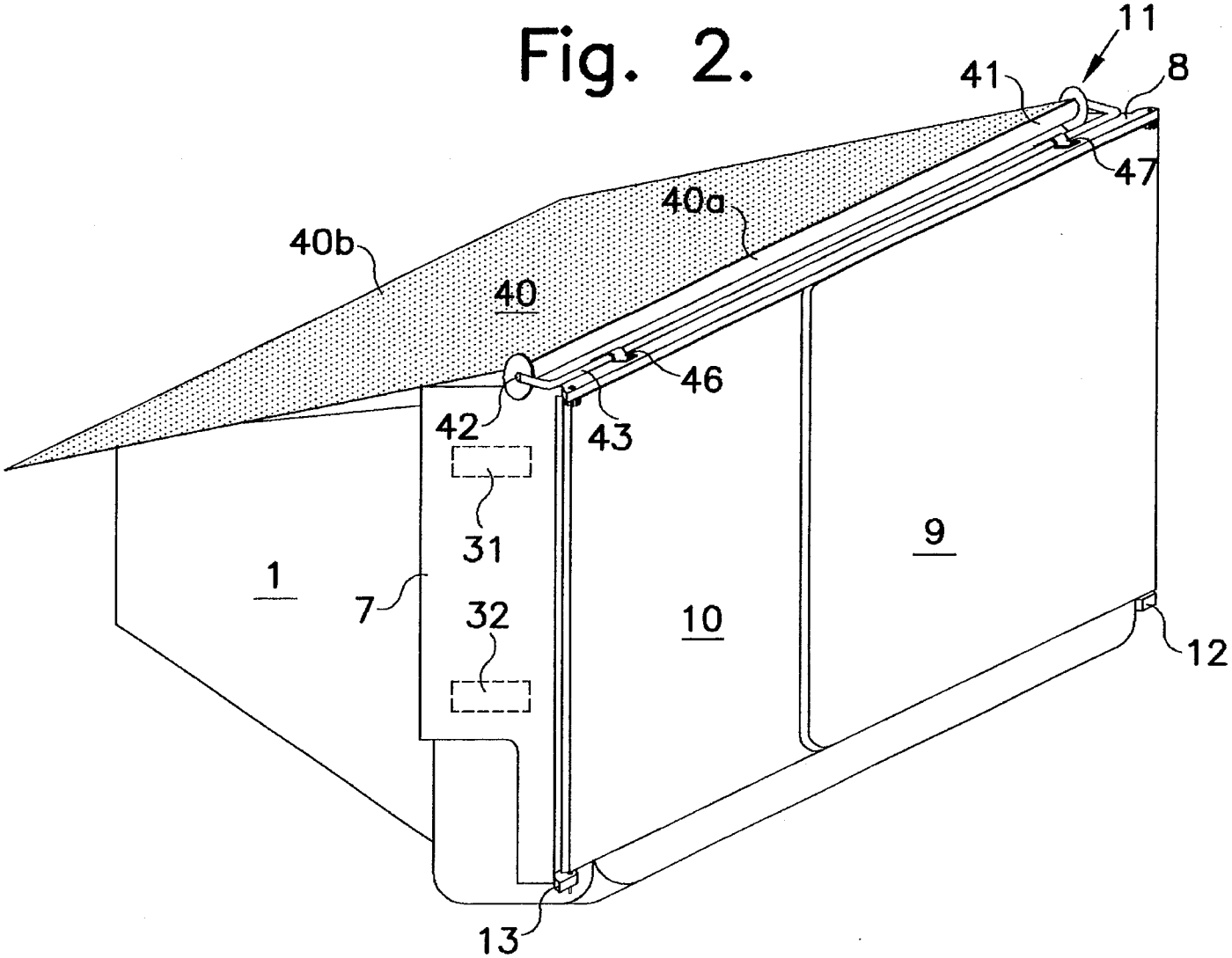
FIG. 2 is a perspective view of a similar copy holder to FIG. 1 in a dust protecting closed position.

Referring now to the drawings, FIGS. 1 and 2 illustrate typical embodiments of the invention wherein the holder is mounted to a video computer monitor, being illustrated in open and closed positions. Video monitor 1, is illustrated as comprising screen 2 and vent openings 3. The copy holder is illustrated as comprising attachment frame 5 which generally comprises first end member 6, second end member 7 and upper member 8. First opposing panel 9 is pivotally mounted adjacent end member 6, second opposing panel 10 is pivotally mounted adjacent end member 7 and retractable cover assembly 11 is mounted to upper member 8.

Figure 4:
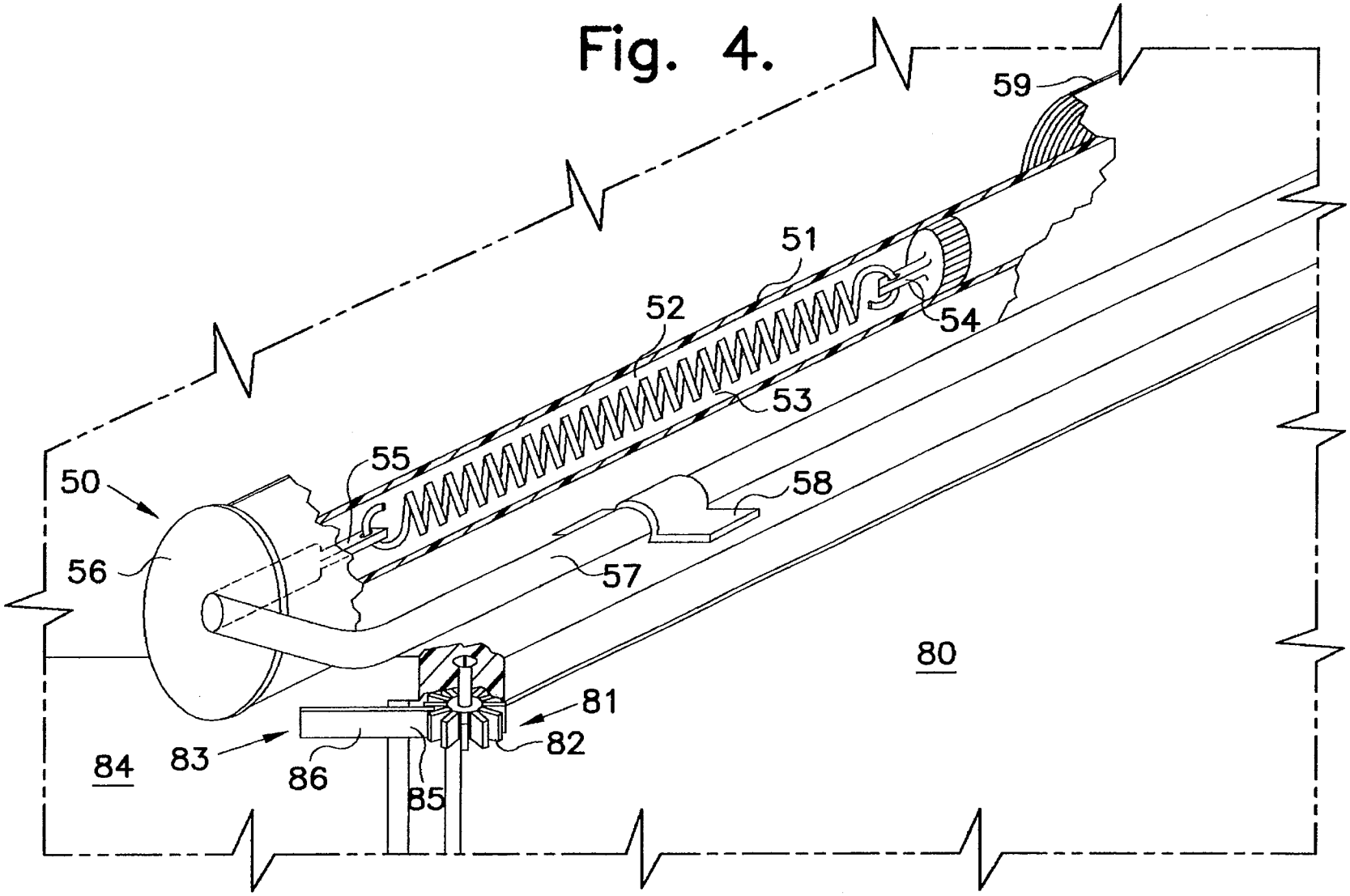
FIG. 4 is a fragmentary perspective view showing a retractable cover assembly of the copy holder of FIG. 1.

In this embodiment panel 9 is pivotally mounted, at pivoting end 9*a*, to end member 6 at support 12, and to upper member 8 at 14. Panel 10 is pivotally mounted, at pivoting end 10*a*, to end member 7 at support 13, and to upper member 8 at 15. Pivot pin 16 is arranged to extend from panel 10 downwardly through a hole in support 13. Another pivot pin, not shown, is arranged to extend upwardly from panel 10 to a hole in upper member 8 at 15. Groove members 17 and 18 are illustrated as connected to panels 10 and 9, respectively, and comprise wheel like elements having a series of grooves spaced around their periphery. Cogs, not shown, are arranged to engage the groove members and resist pivot movement by the panel. FIG. 4 shows an arrangement of the groove members and cogs, wherein cogs are mounted to end members 6 and/or 7 in an arrangement wherein the cogs are engaged and disengaged from grooves of a groove member as a panel is pivoted about its pivoting end.

Retractable cover assembly 11 generally comprises flexible cover 40, mounted at end 40*a* to hollow cylindrical member 41, axle 42, and axle mounting extension 43. End 40*b* generally comprises hook and loop attachment means 44 with mating hook and loop attachment means 45 connected to the monitor. Axle mounting extension 43 is attached to upper member 8 through attachment clamps 46 and 47.

End member 7 detachably engages monitor 1 by means of adhesive strips 31 and 32 which are illustrated in dotted lines. Though not shown, upper member 8 and end member 6 are detachably engaged to the monitor by similar adhesive strips. It should be understood that any suitable means may be used for connecting the mounting frame to the monitor, but generally it is preferred to use convenient detachable means such as adhesive strips or hook and loop arrangements or the like means.

Panel 9, is illustrated in FIG. 1 as comprising a ledge 20 for supporting documents, a spring clip 22 as a means for securing documents to the inside face of the panel and a line guide 21 for use in registering position on a document. Document securing means, lineguides and the like can take many diverse forms for the purposes of this invention with the illustrated embodiment being preferred.

Figure 3:
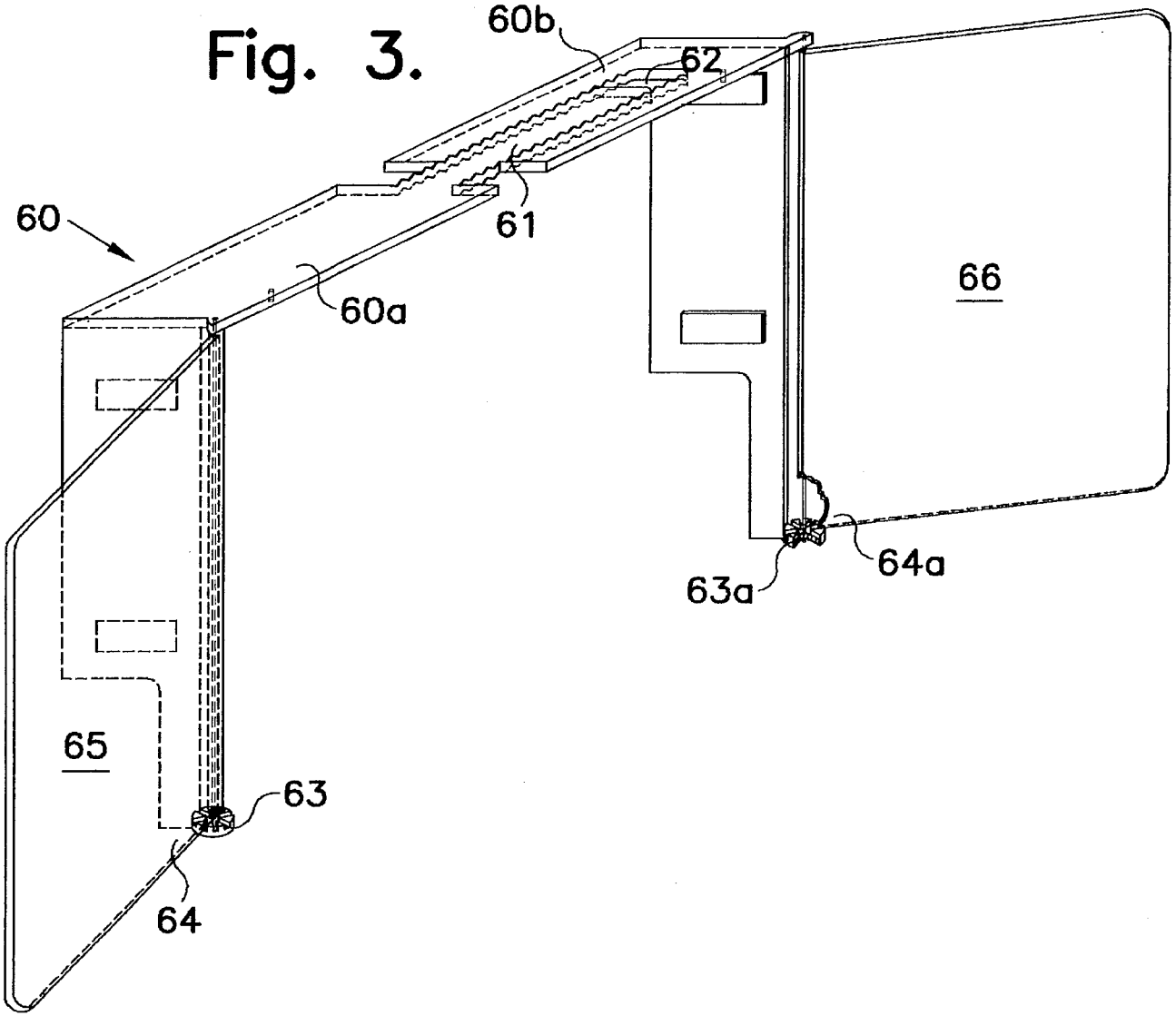
FIG. 3 is a perspective view of another embodiment of a copy holder of the invention.

FIG. 3 illustrates a further embodiment of the invention wherein upper member 60 comprises male member 60*a* and female member 60*b* in opposing adjustable juxtaposition. Male member 60*a* is illustrated as comprising projection 61 which is sized to insert into slot 62 of female member 60*b*. Projection 61 comprises serrated borders which are arranged to mate with serrated borders of slot 62 thus providing means for adjusting the length of upper member 60.

FIG. 3 also comprises a further arrangement of cog and groove means for resisting movement of panels through a pivot, wherein groove members 63 and 63*a* comprise a plurality of grooves extending radially outwardly from a central pivot and ends 64 and 64*a* of panels 65 and 66 comprise the cogs which engage the grooves. It should be understood that it is within the contemplation of the invention to include cogs molded to an end of a panel and shaped to engage said grooves.

In this illustrated configuration the weight of the panel maintains the end, or cog of a panel in a groove to resist pivoting movement of the panel. Movement of a panel upwardly along the pivot axle releases the end from the groove to enable pivoting of the panel about the axle.

FIG. 4 illustrates elements comprising a retractable cover assembly of the invention, mounted to an attachment frame having integral end members, and an embodiment of a cog and groove arrangement of the invention.

Retractable cover assembly 50 is illustrated as comprising cylindrical member 51 which is shown as having hollow 52, spring 53, internal spring mount 54, axle spring mount 55, end piece 56, axle frame 57, axle frame mounting clip 58 and flexible cover 59. Axle spring mount 55 is fixed to axle frame 57, which in turn is mounted by clip 58 to upper member 80, and extends through end piece 56 centrally into hollow 52. Internal spring mount 54 is fixed to cylindrical member 51 and spring 53 extends between internal spring mount 54 and axle spring mount 55 such that rotation of cylindrical member 51 about axle spring mount 55 causes retracting tension loading upon spring 53. The cover is wrapped around the cylindrical member, and tangential stripping of the cover from the cylindrical member causes the cylindrical member to rotate about the axle spring mount and creates retracting tension loading upon the spring. Upon release of the cover stripping force, the retracting tension of the spring causes the cylinder to rotate in reverse of the stripping rotation and the cover again wraps about the cylindrical member.

In the cog and groove arrangement of FIG. 4., the groove comprises a groove member 81 which is illustrated as being fixed to panel 80 and comprises a wheel like arrangement having a series of grooves 82 spaced around its periphery. Cog 83 is mounted to end member 84 and comprises a flexible arm 86. As panel 80 is pivoted, end 85 engages a groove 82 to resist pivoting movement. Flexible arm 86 maintains a tension of end 85 against a groove which can be overcome by forced pivoting of the panel.

Figure 5:
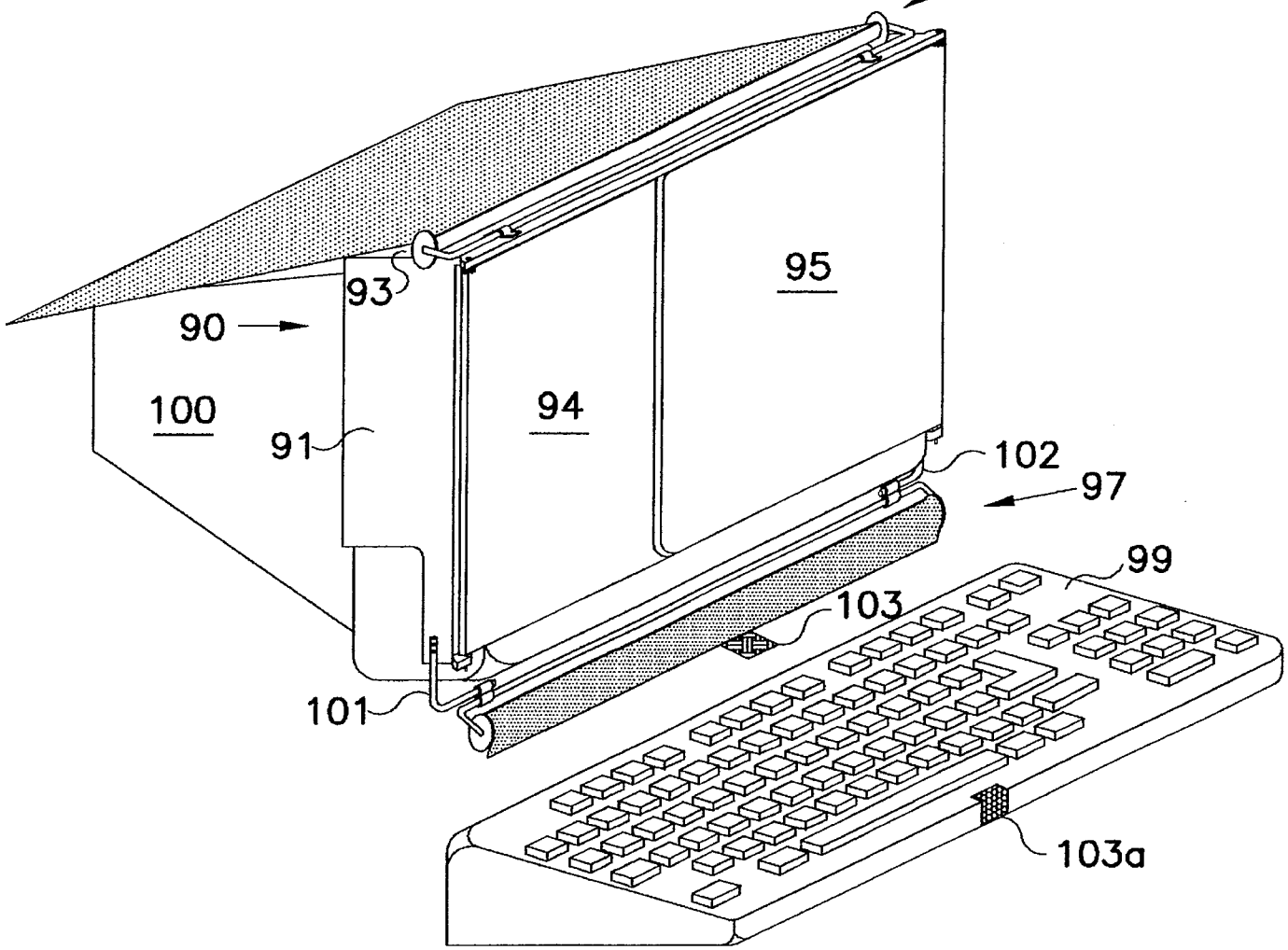
FIG. 5 is a perspective view of another embodiment of the copy holder of the invention.

FIG. 5, provides a further embodiment of the invention illustrating an arrangement wherein a copy holder of the invention is mounted to a video computer monitor 100 and illustrated in a closed position. Attachment frame 90 of the copy holder is illustrated as generally comprising first end member 91, second end member 92, not visible, and upper member 93. A first opposing panel 94 is pivotally mounted adjacent end member 91, a second opposing panel 95 is pivotally mounted adjacent end member 92 (not shown), retractable cover assembly 96 is mounted to upper member 93 and retractable cover assembly 97 is mounted between end members 91 and 92, through mounting brackets 101 and 102, generally positioned below monitor 100. Computer keyboard 99 is positioned adjacent the monitor and stripping the flexible cover from retractable cover assembly 97 and engaging mating hook and loop attachment means 103 and 103*a*, allows securing the keyboard from dust.

Figure 6:
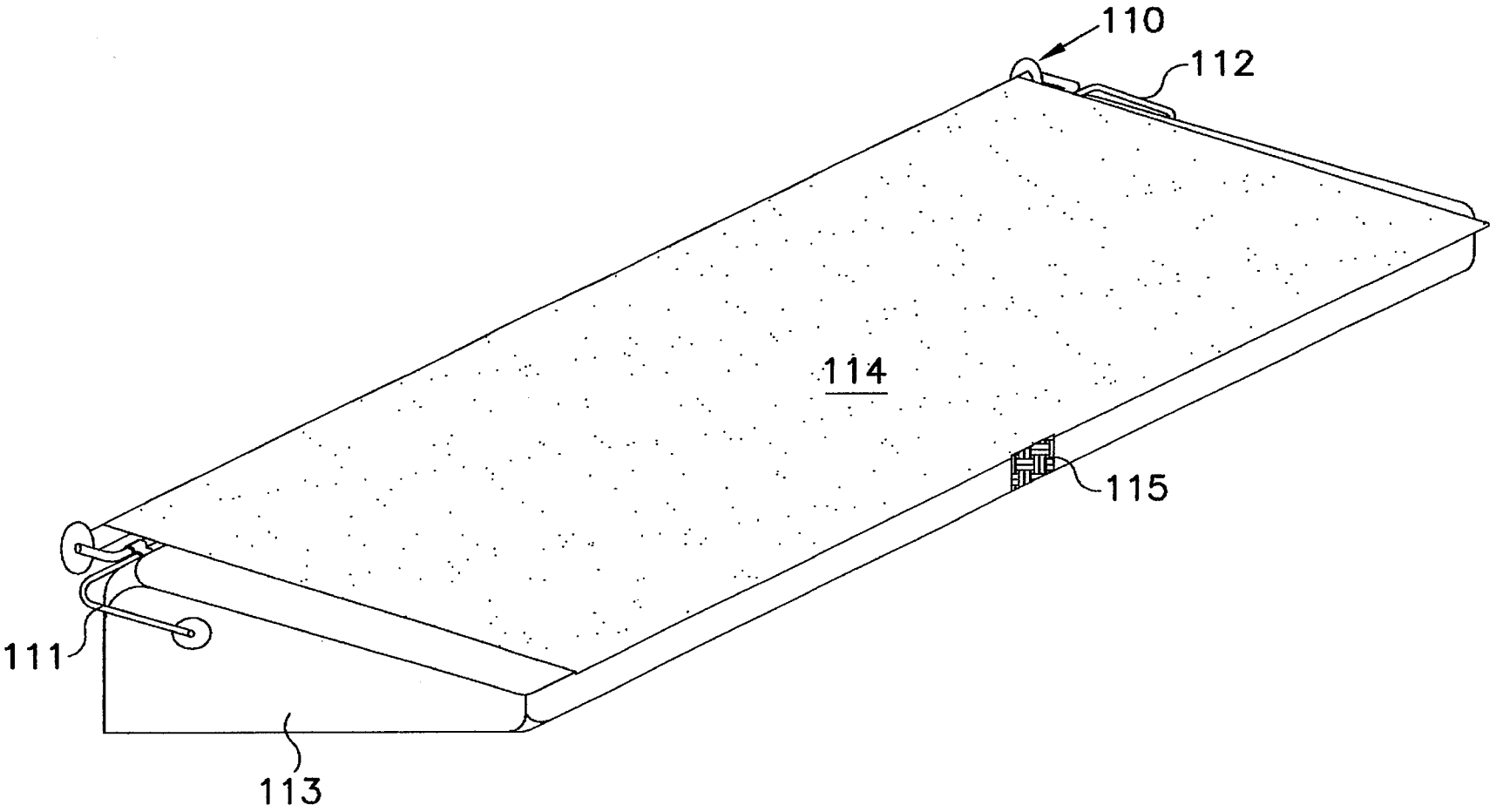
FIG. 6 is a perspective view of a retractable cover assembly mounted to a computer component.

FIG. 6 illustrates an embodiment wherein a retractable cover assembly 110 of the invention is mounted to a computor component through mounting brackets 111 and 112, and cover 114 is secured to the component by hook and loop means 115.

Various other modifications of the illustrated copy holders of the invention are evident which can be seen as providing equivalent copy holders, each of which are contemplated as within the scope of this invention.

I claim:

1. A copy holder for attachment to a video monitor, comprising an attachment frame having a generally horizontally arranged elongate upper member and opposing first and second elongate end members extending about perpendicularly downwardly from opposite ends of said upper member; said upper member being arranged for mounting along an upper surface of said monitor and comprising means for pivotally engaging mating means at an upper end of a panel, at about said opposite ends; said opposing end members being arranged for mounting along opposite side surfaces of said monitor and comprising, at about a lower end thereof, means pivotally engaging mating means at a lower end of said panel; first and second panels, comprising respectively at upper and lower ends, mating means engaging said means for pivotally engaging an end of said upper member and an end of an opposing end member in an arrangement wherein said panels have a pivoting end and an opening end in respective opposing relationship to each other; said pivoting end of said first panel being arranged adjacent said first end member and said pivoting end of said second panel being arranged adjacent said second end member; said arrangement of said first and second panels in respect to said end members being such that the opening ends of said first and second panels are pivotal toward and away from each other in a manner such that said panels cover a screen of said monitor when pivoted to a closed position.

2. The copy holder of claim 1 wherein a panel comprises a document securing means.

3. The copy holder of claim 2 wherein said document securing means comprises a spring loaded means for gripping a document to said panel.

4. The copy holder of claim 1 wherein a panel is rigid.

5. The copy holder of claim 1 wherein a panel comprises a ridge which is arranged to support a document.

6. The copy holder of claim 1 wherein the length of said upper member is adjustable.

7. The copy holder of claim 6 wherein said upper member comprises adjacent members which slidably engage to an adjustable length.

8. The copy holder of claim 1 wherein an opposing member is removably attached to an end of said upper member.

9. The copy holder of claim 1 wherein an opposing end member is integrally molded to said upper member.

10. The copy holder of claim 1 wherein said upper member comprises a means for shielding a surface of said monitor from dust.

11. The copy holder of claim 10 wherein said means for shielding comprises a retractable flexible cover.

12. The copy holder of claim 11 wherein said cover is retractably mounted to a cylindrical member which is spring loaded about a central axle.

13. The copy holder of claim 12 wherein said central axle is supported at opposite ends and attached to said upper member.

14. The copy holder of claim 1 comprising a means for shielding a keyboard or printer from dust.

15. The copy holder of claim 14 wherein said means for shielding said keyboard or printer comprises a flexible cover retractably mounted to a cylindrical member, which is spring loaded about a central axle and extends between said opposing end members.

16. The copy holder of claim 1 wherein a panel is pivotal through a plurality of pivot resistant positions.

17. The copy holder of claim 16 comprising a cog and groove means for resisting movement through said pivot resistant positions.

18. The copy holder of claim 17 wherein said cog and groove means are arranged so that weight of said panel engages said cog in said groove.

19. The combination comprising a copy holder of claim 1, one of a monitor, keyboard or printer having connected thereto a flexible cover retractably mounted to a cylindrical member, which is spring loaded about a central axle in a manner so that it can be extended to cover a surface.

* * * * *